US006652419B1

(12) United States Patent
Rota

(10) Patent No.: US 6,652,419 B1
(45) Date of Patent: Nov. 25, 2003

(54) INTEGRATED EXERCISE AND CONDITIONING SYSTEM FOR THE HUMAN BODY

(76) Inventor: James Eugene Rota, 924 Westwood Blvd., Suite 505, Los Angeles, CA (US) 90024

( * ) Notice: Subject to any disclaimer, the term of this patent is extended or adjusted under 35 U.S.C. 154(b) by 8 days.

(21) Appl. No.: 10/151,665

(22) Filed: May 20, 2002

(51) Int. Cl.[7] ..... A63B 5/11

(52) U.S. Cl. ..... 482/27; 482/28; 482/29; 482/38; 482/62; 482/77

(58) Field of Search ..... 482/27–28, 38–40, 482/62, 77, 29

(56) References Cited

U.S. PATENT DOCUMENTS

| | | | | | |
|---|---|---|---|---|---|
| 689,418 | A | * | 12/1901 | Ryan | 482/62 |
| 726,095 | A | * | 4/1903 | Nightingale | 482/62 |
| 1,104,505 | A | * | 7/1914 | Holworthy | 482/62 |
| 2,919,134 | A | * | 12/1959 | Zuro | 482/39 |
| 3,427,019 | A | * | 2/1969 | Brown | 482/77 |
| 3,716,232 | A | * | 2/1973 | Johnson | 272/63 |
| 4,305,579 | A | | 12/1981 | Rice | 482/147 |
| 4,337,942 | A | | 7/1982 | Sidlinger et al. | 482/142 |
| 4,369,966 | A | | 1/1983 | Silberman et al. | 482/38 |
| 4,391,441 | A | | 7/1983 | Simjian | 482/131 |
| 4,415,151 | A | * | 11/1983 | Daniels | 272/65 |
| 4,477,070 | A | * | 10/1984 | Appelbaum | 272/70 |
| 4,478,420 | A | | 10/1984 | Sowards | 473/435 |
| 4,489,933 | A | | 12/1984 | Fisher et al. | 482/28 |
| 4,598,905 | A | | 7/1986 | Vrana | 482/27 |
| 4,824,100 | A | * | 4/1989 | Hall et al. | 272/65 |
| 4,836,530 | A | | 6/1989 | Stanley, Jr. | 482/27 |
| 4,949,956 | A | * | 8/1990 | Pobran | 272/62 |
| 5,674,157 | A | | 10/1997 | Wilkinson | 482/83 |
| 5,788,606 | A | * | 8/1998 | Rich | 482/27 |
| 6,110,074 | A | | 8/2000 | Tacquet | 482/27 |
| 6,237,169 | B1 | | 5/2001 | Ying | 5/111 |

* cited by examiner

*Primary Examiner*—Nicholas D. Lucchesi
*Assistant Examiner*—Lori Baker Amerson

(57) ABSTRACT

An integrated exercise machine system that is utilized to facilitate overall physical fitness which includes the detoxification of the body along with the aerobic conditioning of the cardiovascular system. The system was primarily designed to facilitate a proactive approach to the conditioning of muscles that have become fatigued or atrophied in various occupations, such as computer operators, clerical personnel, or other occupations that have limited range of motions, and improve mobility of the elderly and physically impaired. It is a uniquely shaped, portable rebounder that folds with a safety hinge and collapsing legs. An overhead upper body exercise system is adapted to the environment utilizing a dual telescopic primary horizontal overhead bar, adapts to a door frame or wall, and is housed in a cradle unit. There are two adjustable securing straps with a device for attaching and suspending the secondary horizontal bar and/or elastic resistance ropes with varying degrees of elasticity. Hand grips can be attached to the adjustable straps or elastic resistance ropes. The elastic resistance ropes may be attached to the frame of the rebounder.

4 Claims, 7 Drawing Sheets

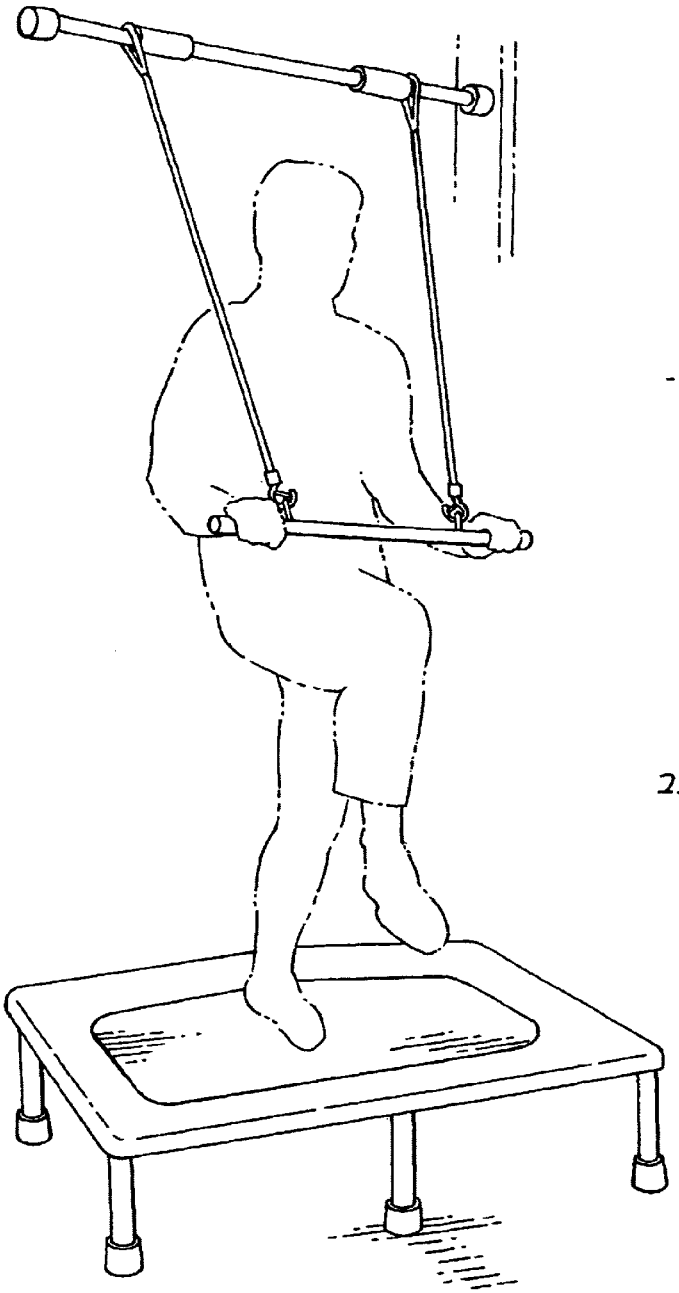
FIG. 1B
FIG. 5
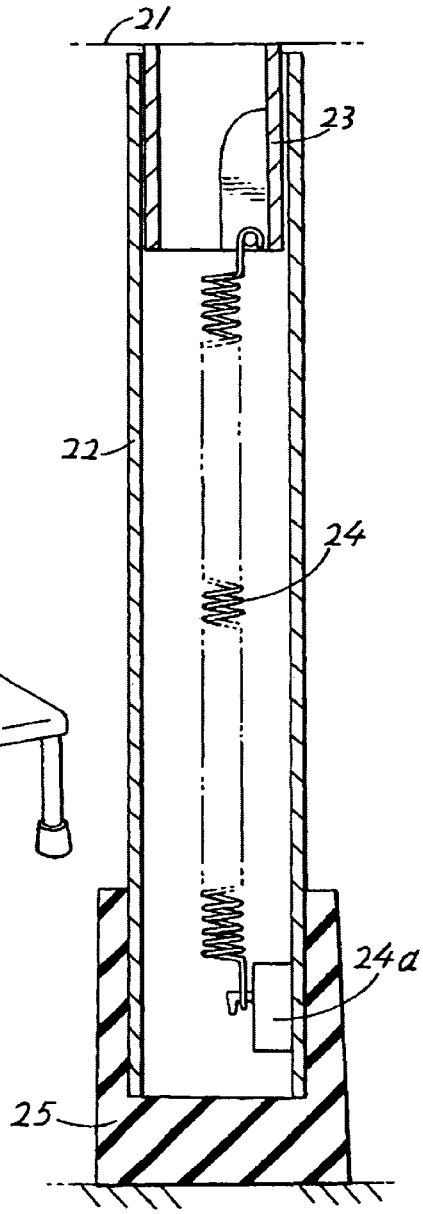

INTEGRATED EXERCISE AND CONDITIONING SYSTEM FOR THE HUMAN BODY

CROSS REFERENCE TO RELATED APPLICATIONS

Not Applicable

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of health and fitness and more specifically to an exercise system for the human body that integrates rebounding with upper body resistance conditioning. This system emphasizes the stretching and conditioning of muscles that have been become fatigued or atrophied, as in various occupations, such as computer operators, clerical personnel, and other occupations that have limited range of motion. The benefits of increased mobility are also experienced by the elderly and disabled. As a practicing dentist for 40 years, in the past I was bothered with leg and back problems. Conventional proactive exercise practices and equipment did not allow me to conveniently address this problem without aggravating my condition. After experimenting with various methods and equipment, I designed a system that was more user friendly with my chronic condition and uniquely solved my problem. Now, at the age of 68, I have been using and developing the invention for 12 years, and I am in great condition, still practicing dentistry, without the physical ailments that were part of my life in the past.

Rebounding for the purpose of exercise started in approximately 1981. Since then, the health and fitness community has become increasingly aware of the extensive benefits of this form of exercise. Whereas resistance training has long been used throughout time for increasing muscle strength. At this time, there is no exercise apparatus that integrates the highly effective fitness programs of aerobic workout, resistance training, and rebounding.

Presently, there are rebounders of varying sizes and shapes. Many studies have been conducted regarding the advantages of rebounding, finding that it is one of the most beneficial aerobic exercises ever developed. The benefits derived from rebounding include exercise without trauma to the muscle and joint system, detoxification, oxygenation of the blood and cells, stabilizing effect on the nervous system, physical strengthening of the lower body muscles, elimination, and strengthening of the heart. Rebounder exercise effectively promotes the lymphatic process, thereby facilitating detoxification. Unlike the arterial system, the lymphatic system does not have its own pump. It has no heart muscle to move the fluid around its lymph vessels. There are just three ways to activate the flow of lymph away from the tissues it serves and back into the main pulmonary circulation. Lymphatic flow requires muscular contraction from exercise and movement, gravitational pressure, and internal massage to the valves of the lymph ducts. Rebounding supplies all three methods of removing waste products from the cells and from the body. Rebound exercise also strengthens the heart in two ways: It improves the tone and quality of the muscle itself, and it increases the coordination of fibers as they wring blood out of the heart during each beat. People who rebound, find that they can work longer, sleep better, and feel less nervous and tense.

Currently, simple methods of resistance training exist in the form of various stretching devices. Resistance training offers the benefits of muscular strengthening, improvement of posture and body composition, decrease likelihood of injury, body conditioning and muscle toning. Clinical studies have shown regular exercise to be one of the best tools for effective stress management. Researchers have observed that even limited resistance training in the elderly has shown a number of structural and metabolic benefits being proactive in the prevention of osteoporosis. In particular, the susceptibility to falls, management of low back pain, obesity, and weight control are all positively impacted by resistance training in the elderly. Hip fracture incidence is reduced by even limited exercises. The composition of bones is improved along with blood fats and glucose levels. Resistance training is important in achieving physical fitness for a person of any age.

This invention is unique in that it will incorporate the benefits of both the rebounder and resistance training, addressing the total fitness of the individual, conveniently and economically. The invention provides an effective total body workout with resistance training, aerobic exercise and detoxification of the body.

Rebounders, of varying sizes and shapes, are principally designed for rebounding alone. As stated earlier, rebounders alone have their benefits, but primarily exclude the conditioning of the upper body. Also, these devices do not incorporate overhead support which can easily and conveniently facilitate resistance exercises and spinal stretching. The overhead system is also required to stabilize and support the elderly or the physically impaired. The rebounders presently equipped to offer support are not stable and do not offer upper body conditioning features. They also do not address the release of back tension and stretching of the spinal column that is offered by the invention. The overhead system offers the elderly and disabled a safe, supportive system during the rebounding exercises.

Current resistance training available to the consumer does not offer a simultaneous aerobic experience or detoxification process of the body.

The invention offers the user an effective total body workout while addressing aerobic and detoxification needs. This exercise system is also easy to use and promotes enhanced mobility and health for all users.

BRIEF SUMMARY OF THE INVENTION

The object of this invention is to integrate the various body exercise and conditioning methods into a low-cost device that is conveniently installed, using a safe and secure system, that will offer the multi-generational user an opportunity to take advantage of methods of becoming proactive in developing optimum health.

A primary object of the invention is to provide an exercise system that can be conveniently used by the elderly and disabled.

Another object of the invention is to provide a cardiovascular exercise system.

Another object of the invention is to provide an exercise system for detoxification of the body.

Yet another object of the invention is to provide a system that stretches the spinal column.

A further object of the invention is to provide an integrated exercise system to facilitate the conditioning of the upper and lower body.

Still yet another object of the invention is to provide a simple system that can be portable.

Another object of the invention is to provide an exercise system that is easy to install.

Another object of the invention is to provide an exercise system at a low cost to the consumer.

A further object of the invention is to provide a system that can be adjusted for all ages.

Still yet another object of the invention is to provide a system that can be adapted to accommodate a range of muscular tolerances.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an integrated exercise machine system that is utilized to promote overall physical fitness, especially with the elderly and disabled. This system facilitates the detoxification of the body, along with the aerobic conditioning of the cardiovascular system. The rebounder is a uniquely shaped, portable unit that folds with a molded safety hinge and collapsing legs. The overhead upper body exercise unit can easily be adapted to the environment, utilizing a dual telescopic primary horizontal overhead bar secured in cradles conveniently attached to a door frame or to a wall by means of the cradles being mounted to a wall bracket. A secondary bar is suspended from the primary overhead bar by adjustable securing straps that are attached to the primary overhead bar. Hand grips attached to elastic resistance ropes of varying degrees of elasticity are connected to the adjustable straps or the frame of the rebounder and utilized for upper body resistance conditioning.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

FIG. 5 is a perspective view of the collapsible legs on the rebounder.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1A:
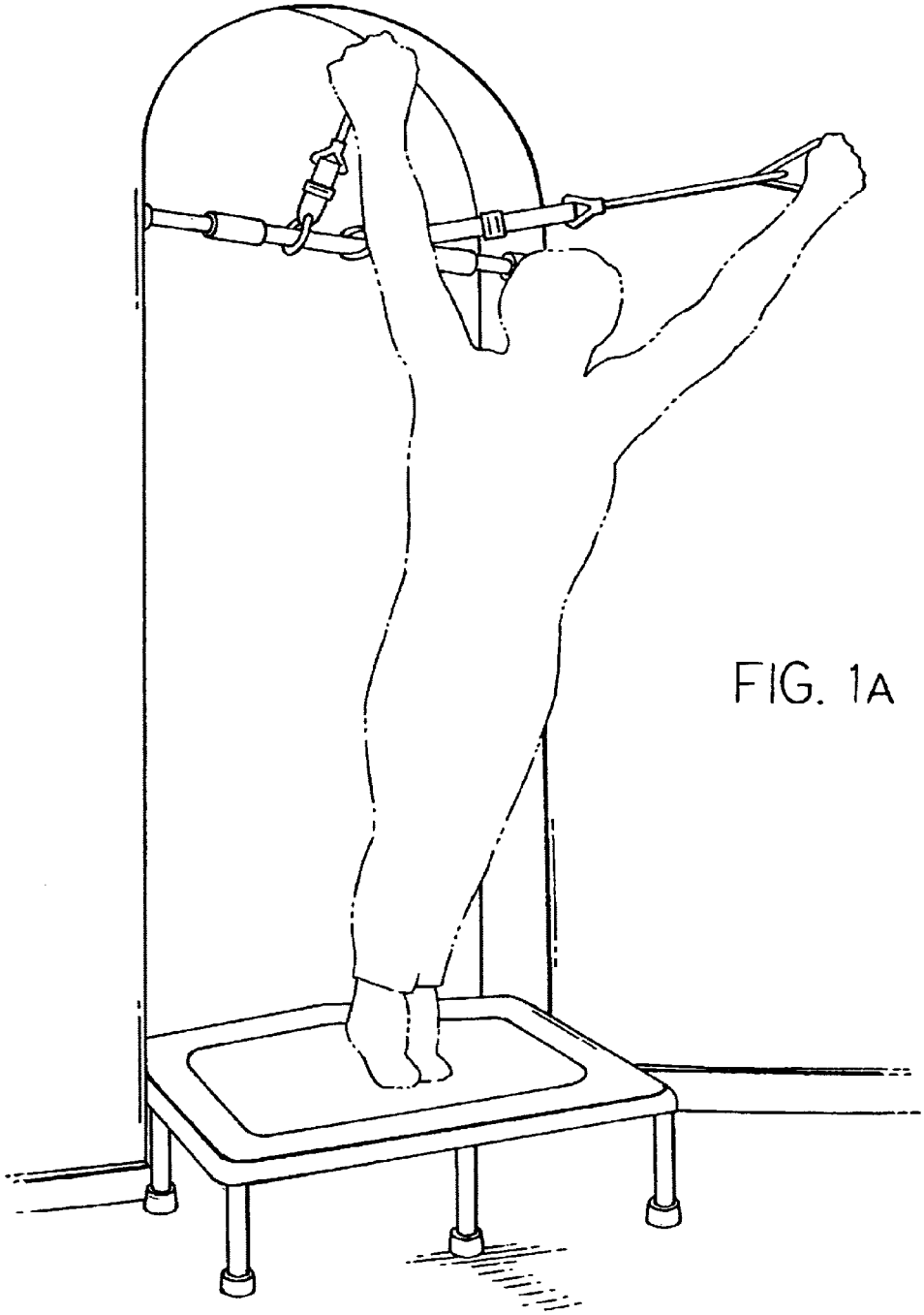
FIG. 1-A, FIG. 1-B, and FIG. 1-C are full perspective views of the invention showing the user applying the integrated system.

The operation of the invention may be understood upon reference to FIG. 1-A, FIG. 1-B and FIG. 1-C, which demonstrate three common exercises in a series of applications available to the user of the integrated system.

Figure 2:
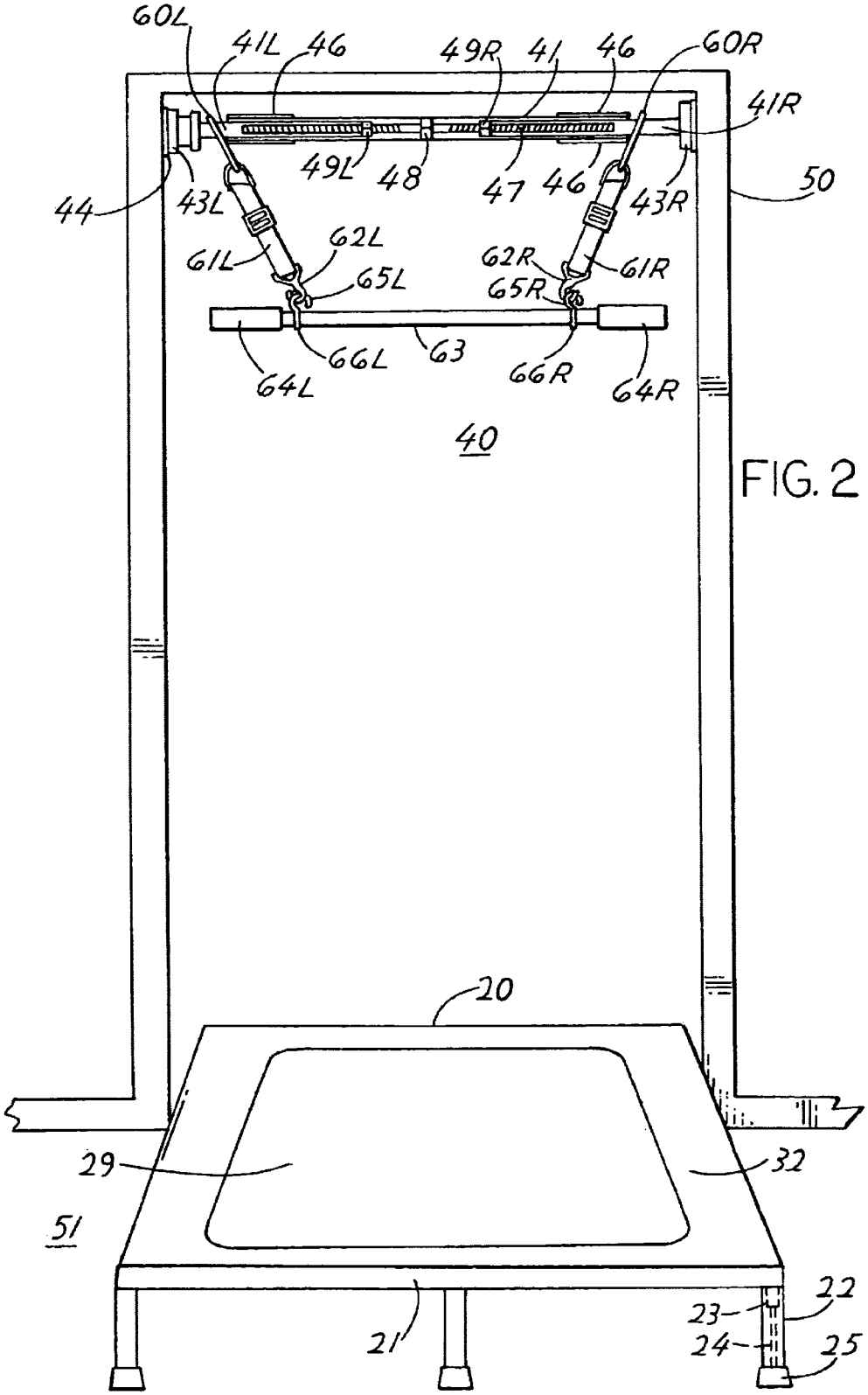
FIG. 2 is a full perspective view of the invention showing the lower rebounder unit and the primary overhead bar attached to a door frame with a secondary bar suspended from it, with detachable and adjustable straps.

In accordance with the present invention, FIG. 2 illustrates an overhead bar system 40 comprised of a dual telescopic bar 41 supported by the door frame 50 to which is attached two adjustable straps 61R, 61L supporting a secondary horizontal bar 63. A rebounder 20 is located within a door frame 50 of a building to be used in conjunction with the overhead system 40. FIGS. 3, 4, 5 and 6 are close-up views of this integrated system.

Figure 4:
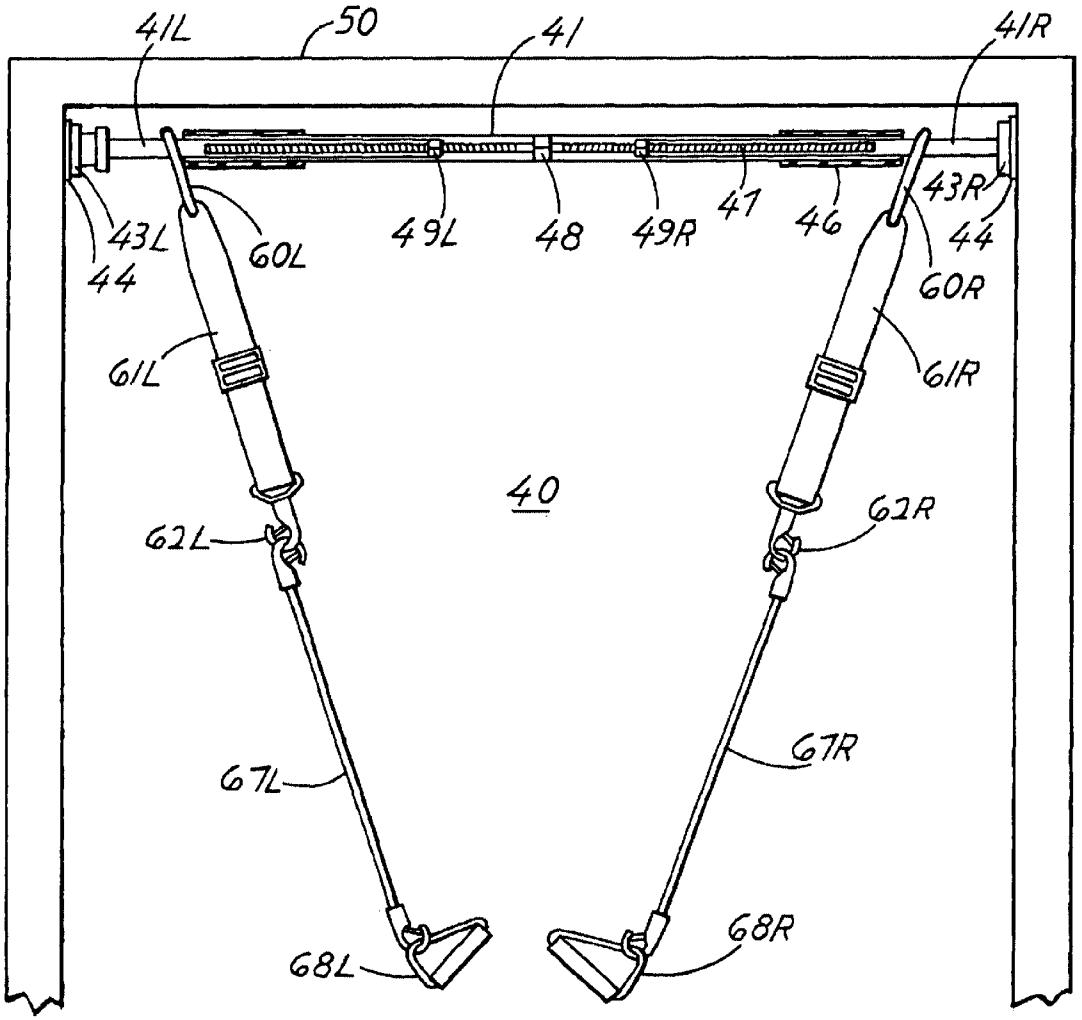
FIG. 4 is a partial perspective view of the primary overhead bar and attachments positioned into the cradles secured to the door frame.

In FIG. 2 and FIG. 4, the overhead dual telescopic bar 41 is extended, to be securely attached into the circular metal cradles 43R and 43L, that are initially attached to the door frame 50 by double-stick adhesive tape 44. The metal cradles 43R, 43L are also secured to the door frame 50. The dual telescopic bar 41 contains a rod screw 47, and is secured in the middle by a retaining collar 48. The telescopic overhead bar 41 receives extension bars 41R, 41L that contain circular nuts 49R and 49L on the insertion portion of the bar. The telescopic extension bars 41R, 41L are expanded to fit into the cradles 43R, 43L, secured to the door frame 50. Rubber hand grips 46 are located on the ends of the telescopic bar 41.

Further in accordance with the invention in FIG. 2, a secondary horizontal bar 63 is suspended from the overhead bar 41, by two adjustable securing straps 61R, 61L, which are attached to the primary horizontal bar 41 by spring links 60R, 60L, and to the primary horizontal bar 41 by strap hooks 62R, 62L, that connect to eye hooks 65R, 65L, that are secured to the secondary horizontal bar 63 with eye hook bolts 66R, 66L. The adjustable straps 61R, 61L may be replaced with elastic resistance ropes 67R, 67L as an alternative exercise application. Rubber ends 64R, 64L finish the secondary horizontal bar 63.

Figure 1C:
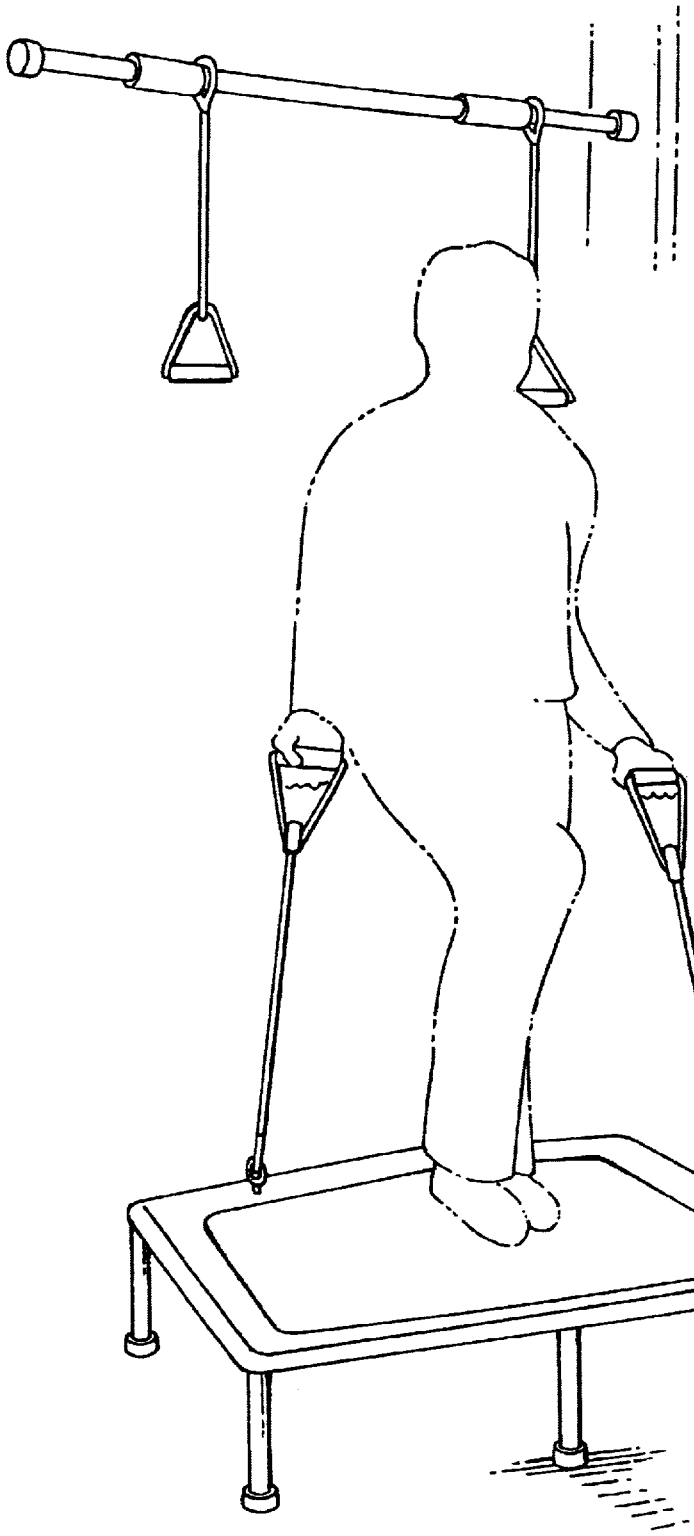
Figure 6:
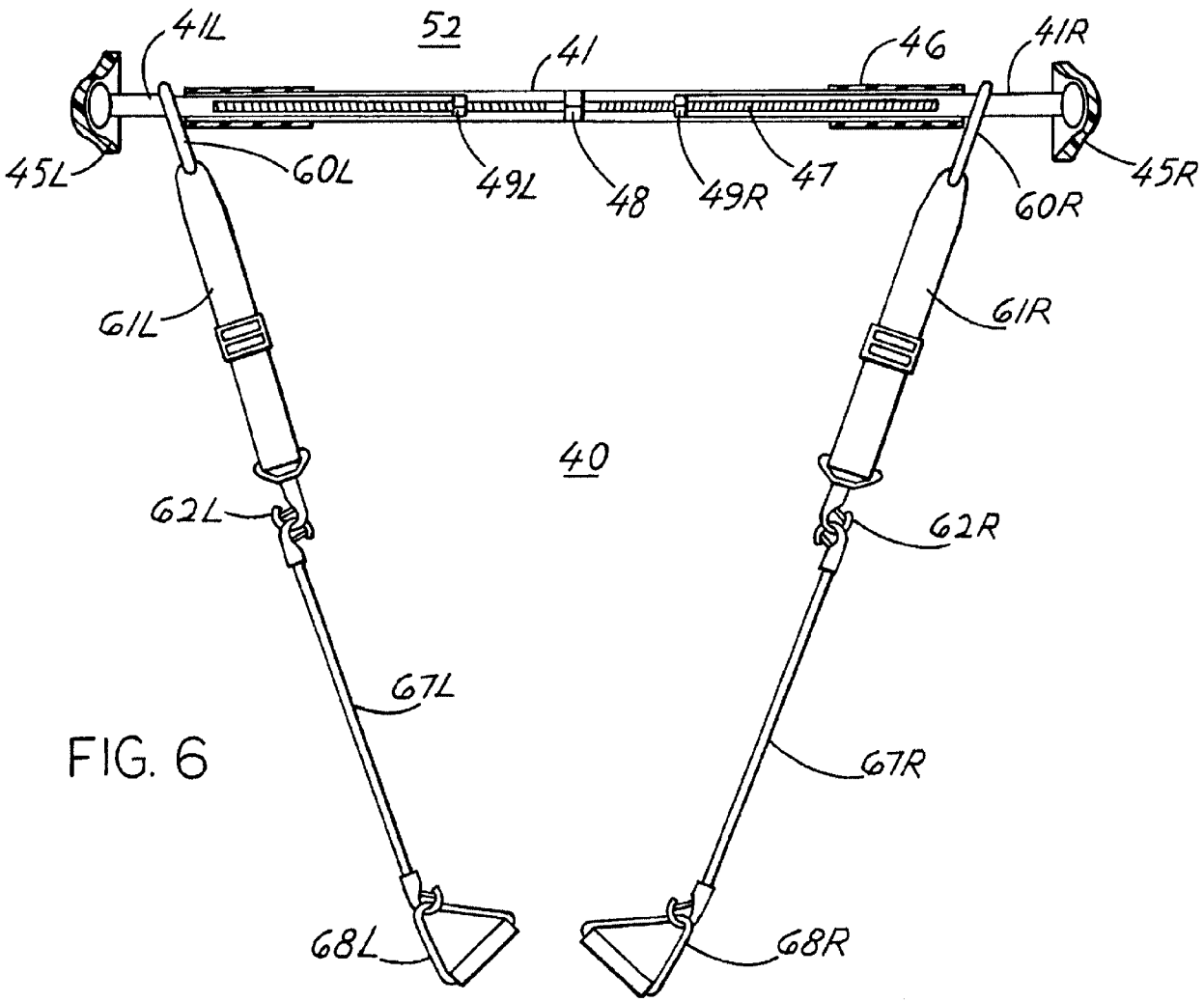
FIG. 6 is a partial perspective view of the primary overhead bar and attachments positioned into the cradles of the mounts secured to the wall.

In keeping with the versatility of the invention, FIG. 4 and FIG. 6 demonstrate additional accessories attached to the adjustable straps 61L, 61R, which are attached to the dual telescopic bar 41. Elastic resistance ropes 67L, 67R are provided in various degrees of resistance. Hands Grips 68L, 68R are attached to the elastic resistance ropes 67L, 67R. Also, as shown in FIG. 6, the user may attach the primary telescopic bar 41 to a wall 52 by utilizing wall mount brackets 45R, 45L. To further demonstrate the versatility of the accessories, as depicted in FIG. 1*c*, the elastic resistance ropes 67L, 67R may be attached to the rebounder 20 to provide additional upper body resistance training.

In the illustrated embodiment depicted in FIG. 2, the narrow end of the rebounder 20, located on the floor of the building 51, is placed under the overhead bar system 40. The rebounder 20 is shown with a frame cover 32, mat 29, and only three legs 22*b*, 22*c*, 22*g* visible of seven total legs in this perspective drawing. The legs 22*a*, 22*b*, 22*c*, 22*d*, 22*e*, 22*f*, 22*g* are finished with a rubber protective end 25.

Figure 3:
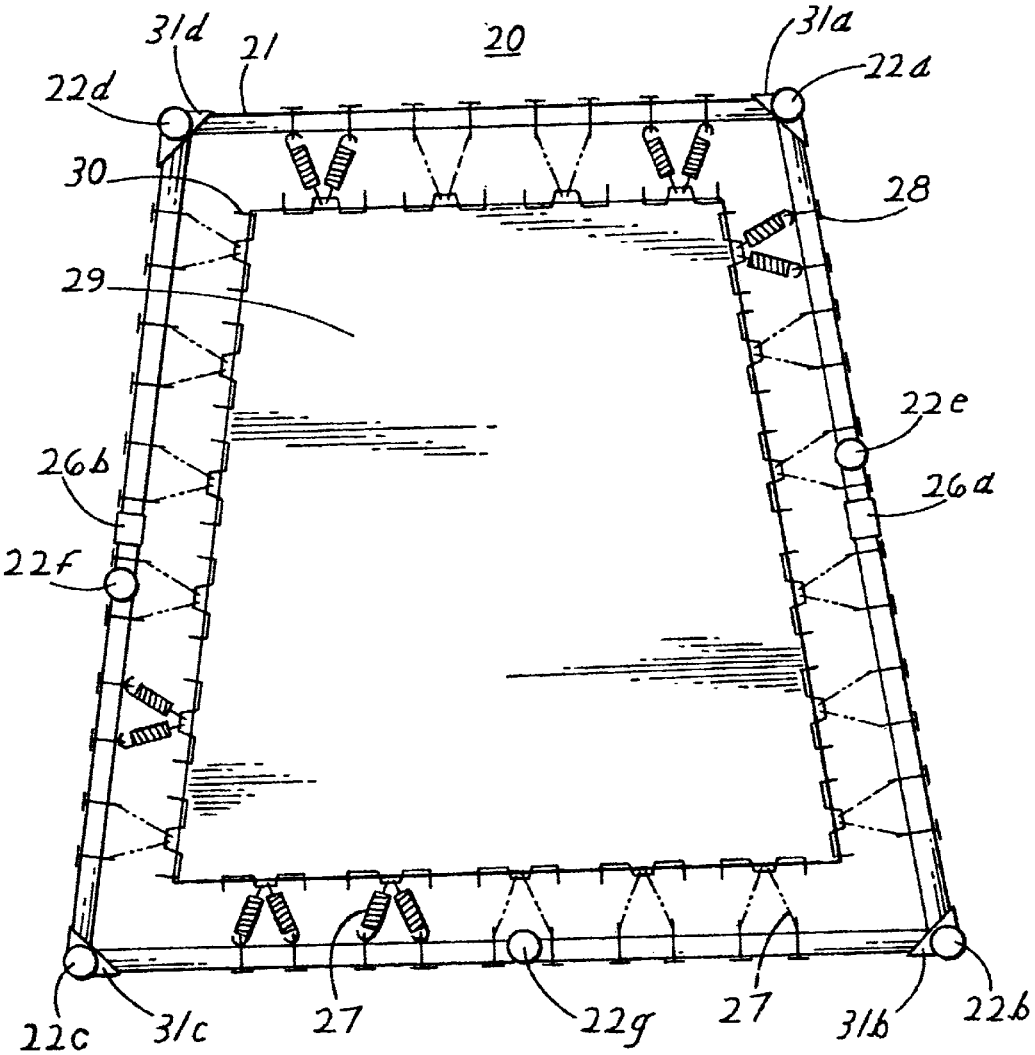
FIG. 3 is a partial perspective overhead view of the underside of the rebounder unit without the protective cover over the springs.

Furthermore, FIG. 3 depicts a direct overhead view of the rebounder 20 turned upside down on the floor of the building 51. The seven folding legs 22*a*, 22*b*, 22*c*, 22*d*, 22*e*, 22*f*, 22*g* are directed upward, with only the leg protective ends 25 in view. The mat 29 of the rebounder 20, is suspended by springs 27, secured to the mat 29 by E-shaped mat attachments 30. The springs 27 are then attached to the frame 21 by T-shaped pins 28, placed into openings drilled through the frame 21, and receive the springs 27. From this overhead view, the protective cover of the four legs 22*a*, 22*b*, 22*c*, 22*d* are located on the corners of the frame 21, and two legs 22*e*, 22*f* are located adjacent to the frame hinges 26*a*, 26*b*, and folding leg 22*g* is located on the long end of the non-hinged side of the rebounder 20. The hinges 26*a*, 26*b* and folding legs 22 allow the rebounder to be collapsible and portable. The corners of the frame 21 are covered with protective guards 31*a*, 31*b*, 31*c*, 31*d*.

FIG. 5 is a close up view of one of the seven legs 22 of the rebounder 20. The securing stud 23 for the spring-loaded folding leg 22 is attached to the frame 21 of the rebounder 20. An internal leg spring 24 attaches the folding leg 22 by joining the securing stud 23 and an internal leg spring attachment 24*a*. The folding legs 22 are finished with a protective rubber end 25.

Having observed the details of the components of the invention, attention may now be given to the operation of the exercise system. The overhead bar system 40 is installed near the top of the door frame 50, as illustrated in FIG. 1. The adjustable straps 61R, 61L that suspend the secondary bar 63 from the primary telescopic bar 41 are adjusted to the user's height requirements. The narrow end of the rebounder 20 is placed under the door frame 50 of the building 51 and the overhead system 40. The user then steps onto the rebounder 20 while grasping the secondary overhead bar 63 for support. Movement on the rebounder 20 can be done in a variety of methods, from simply bouncing on the mat 29 with locked knees to simulating a jogging movement. The motion of the user on the rebounder 20 facilitates the upper body exercises by expanding the range of motion, thereby increasing circulation and reducing muscle fatigue.

The secondary bar 63 may act as a passive support or may be used to exercise the upper body, depending upon the user's upper body tension and movement. The accessory elastic resistance ropes 67L, 67R may be attached to the adjustable straps 61L, 61R or the primary telescopic bar 41, and may be used in various upper body resistance exercises, employing a wide range of movement exercises that are executed simultaneously using the rebounder 20 and the upper body overhead system 40. The bouncing action of the rebounder 20 offers the user the opportunity to exercise the upper body while being supported by the overhead system 40. Further resistance can be employed by utilizing the elastic resistance ropes 67L, 67R of vary degrees of elasticity, which may be attached to the overhead system 40 or the frame 21 of the rebounder 20. The rebounding action reduces the fatigue of the upper body while the user performs resistance exercises.

By changing the user's position on the rebounder 20, the user can employ various back-arching and stretching exercises by leaning forward or backward while being supported by the bar suspension system 40. The continuous employment of the combination of rebounding and upper body exercise movements offers the body effective aerobic cardiovascular conditioning and detoxification. The integrated and full use of this invention offers the user the opportunity to exercise muscles that have become fatigued or atrophied in various occupations, such as computer operators, clerical personnel, or other occupations that have limited range of motions.

Although particular embodiments of the invention have been described and illustrated herein, it is recognized that modifications and variations may readily occur to those skilled in the art, and consequently it is intended that the claims be interpreted to cover such modifications and equivalents. While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. Apparatus for enabling a person to exercise in a room that has a floor and walls, comprising:

a portable rebounder that includes a flexible mat with edge portions, a frame with legs having lower ends resting on the room floor and supporting the frame above the room floor, and a multiplicity of springs that support said mat edge portions on said frame to rebound a person who jumps on the mat;

an elongated horizontal top bar mounted on the walls at least as high as the top of the person;

elements extending at least partially downward from said top bar and grippable by the person's hands, whereby to enable the person to steady himself or herself while jumping on and rebounding from the mat.

2. The apparatus described in claim 1 wherein:

said walls form a doorway, and said top bar extends across said doorway;

said rebounder has a width less than said doorway and at least one end of said rebounder lies in said doorway.

3. The apparatus described in claim 1 wherein:

said elements include a horizontal lower bar, and adjustable hangers that support said horizontal lower bar at a selectable height below said top bar.

4. The apparatus described in claim 1 wherein:

said elements include a pair of flexible elongated ropes with hand grips at their ends opposite said top bar.

* * * * *